US011330912B1

(12) United States Patent
Jolley

(10) Patent No.: US 11,330,912 B1
(45) Date of Patent: May 17, 2022

(54) BED SHEET TENSIONING SYSTEM

(71) Applicant: Sean Jolley, Birdsboro, PA (US)

(72) Inventor: Sean Jolley, Birdsboro, PA (US)

( * ) Notice: Subject to any disclaimer, the term of this patent is extended or adjusted under 35 U.S.C. 154(b) by 0 days.

(21) Appl. No.: 17/176,325

(22) Filed: Feb. 16, 2021

(51) Int. Cl.
*A47C 21/02* (2006.01)

(52) U.S. Cl.
CPC ..... *A47C 21/022* (2013.01)

(58) Field of Classification Search
CPC ..... A47C 21/02; A47C 21/022; A47C 21/024; A47C 21/026; A47C 21/028
USPC ..... 242/155 R, 225, 388, 388.6
See application file for complete search history.

(56) References Cited

U.S. PATENT DOCUMENTS

| | | | | |
|---|---|---|---|---|
| 1,877,610 | A * | 9/1932 | Steiner | A61G 7/0502 108/90 |
| 3,092,848 | A | 6/1963 | Gronvold | |
| 4,644,599 | A * | 2/1987 | Wolcott | A61G 7/0501 5/504.1 |
| 6,108,837 | A * | 8/2000 | Knebel, III | A47C 21/022 24/457 |
| 6,520,444 | B1 * | 2/2003 | Muller | H02G 11/02 242/378.4 |
| D690,539 | S | 10/2013 | Grill | |
| 2,930,053 | A1 | 6/2015 | Boss | |
| 9,492,022 | B2 * | 11/2016 | Nekhala | A47G 9/0246 |
| 10,405,671 | B2 * | 9/2019 | Emile | A47C 21/028 |
| 2004/0060113 | A1 * | 4/2004 | Lantagne | A47C 21/022 5/494 |
| 2006/0000061 | A1 * | 1/2006 | Ota | A47C 21/022 24/72.5 |
| 2009/0172881 | A1 * | 7/2009 | Peterson | A47C 21/022 5/496 |
| 2013/0283528 | A1 * | 10/2013 | Tzur | A47C 21/022 5/498 |
| 2016/0022053 | A1 * | 1/2016 | Martin | A47C 31/08 5/703 |
| 2018/0055238 | A1 * | 3/2018 | Emile | A47C 21/028 |
| 2018/0368526 | A1 | 12/2018 | Bock | |
| 2019/0014913 | A1 | 1/2019 | Poletowski | |
| 2021/0121346 | A1 * | 4/2021 | Zhou | A61G 7/1026 |

FOREIGN PATENT DOCUMENTS

| | | |
|---|---|---|
| WO | 20120212235 | 9/2020 |

* cited by examiner

*Primary Examiner* — Peter M. Cuomo
*Assistant Examiner* — George Sun
(74) *Attorney, Agent, or Firm* — Kyle A. Fletcher, Esq.

(57) ABSTRACT

The bed sheet tensioning system is configured for use with a bed. The bed comprises a mattress, a box spring, and a sheet. The bed sheet tensioning system mounts in the box spring. The bed sheet tensioning system attaches to the perimeter of the sheet at two or more locations. The bed sheet tensioning system applies a tension to the sheet as the sheet is placed over the mattress. The bed sheet tensioning system comprises a plurality of tensioning devices, a plurality of cords, a plurality of clips, a plurality of grommets, and a control circuit. The plurality of cords and clips secure the sheet to the tensioning device. The plurality of grommets protect and guide the plurality of cords through the box spring. The control circuit independently controls the operation of each of the plurality of tensioning devices.

19 Claims, 6 Drawing Sheets

BED SHEET TENSIONING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic articles including beds and bed sheets, more specifically, a bed sheet holder. (A47C21/022)

SUMMARY OF INVENTION

The bed sheet tensioning system is configured for use with a bed. The bed comprises a mattress, a box spring, and a sheet. The bed sheet tensioning system mounts in the box spring. The bed sheet tensioning system attaches to the perimeter of the sheet at two or more locations. The bed sheet tensioning system applies a tension to the sheet as the sheet is placed over the mattress. The bed sheet tensioning system comprises a plurality of tensioning devices, a plurality of cords, a plurality of clips, a plurality of grommets, and a control circuit. The plurality of cords and clips secure the sheet to the tensioning device. The plurality of grommets protect and guide the plurality of cords through the box spring. The control circuit independently controls the operation of each of the plurality of tensioning devices.

These together with additional objects, features and advantages of the bed sheet tensioning system will be readily apparent to those of ordinary skill in the art upon reading the following detailed description of the presently preferred, but nonetheless illustrative, embodiments when taken in conjunction with the accompanying drawings.

In this respect, before explaining the current embodiments of the bed sheet tensioning system in detail, it is to be understood that the bed sheet tensioning system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bed sheet tensioning system.

It is therefore important that the claims be regarded as including such equivalent construction insofar as they do not depart from the spirit and scope of the bed sheet tensioning system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
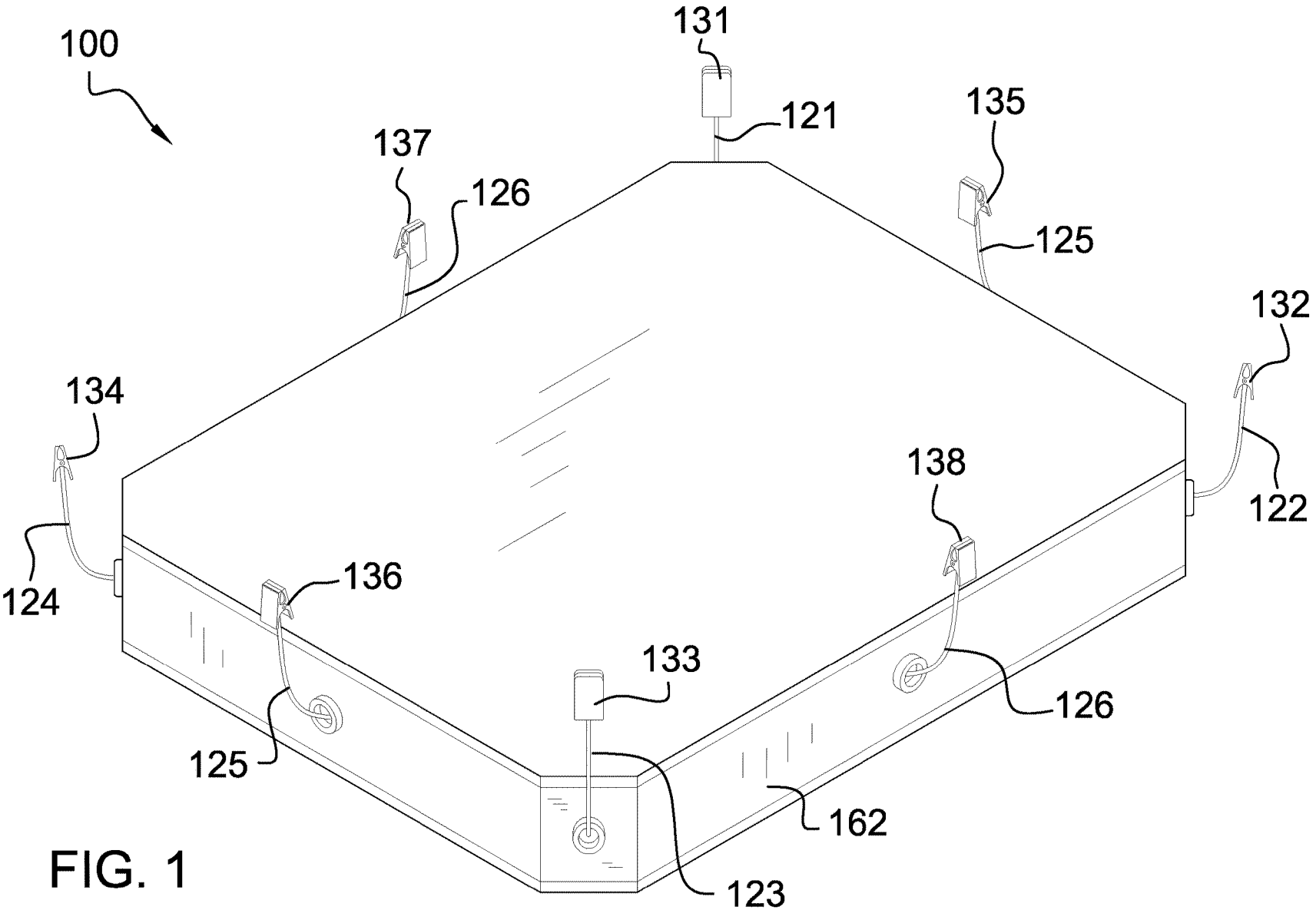
FIG. 1 is a perspective view of an embodiment of the disclosure.
Figure 2:
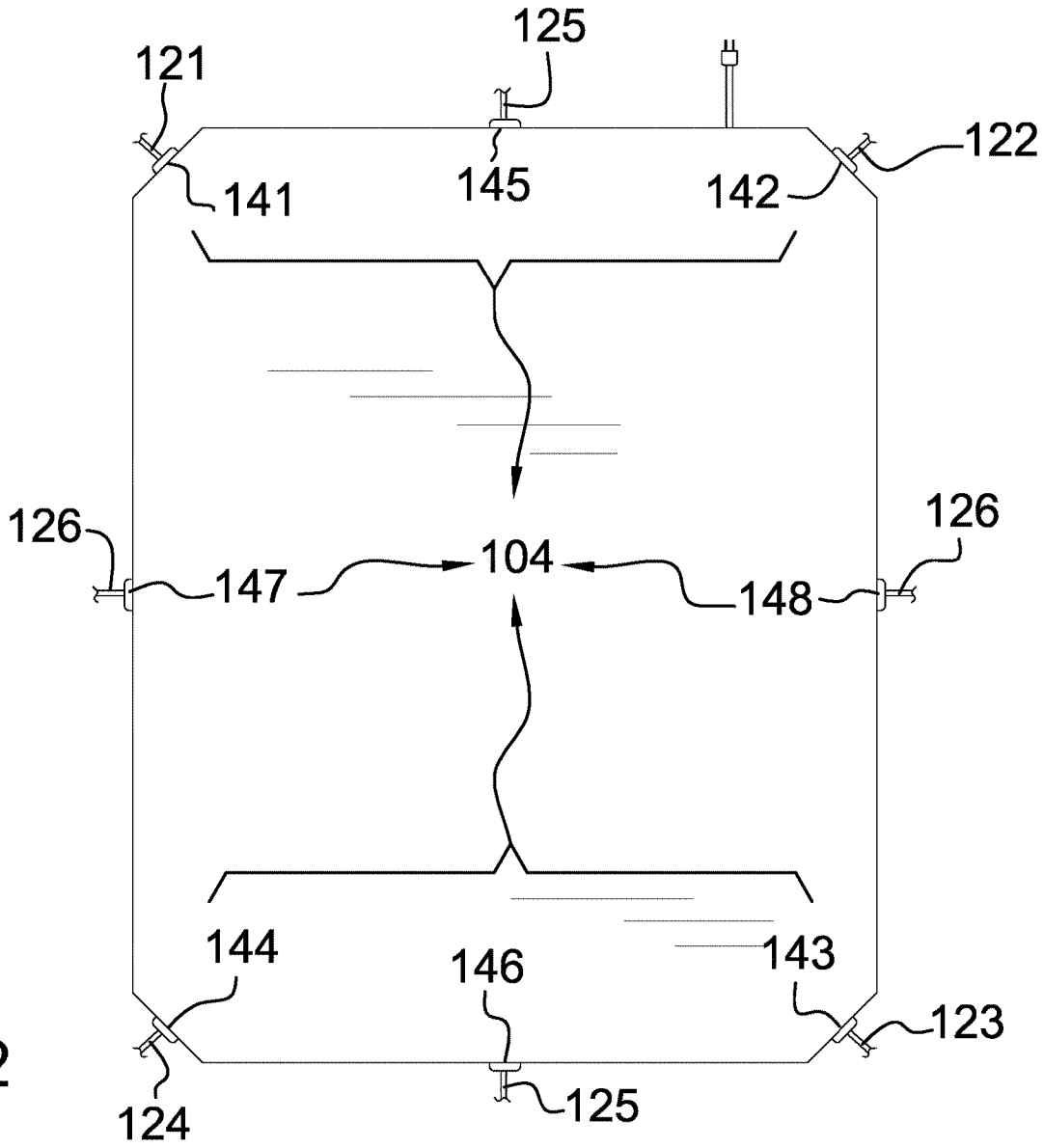
FIG. 2 is a top view of an embodiment of the disclosure.
Figure 4:
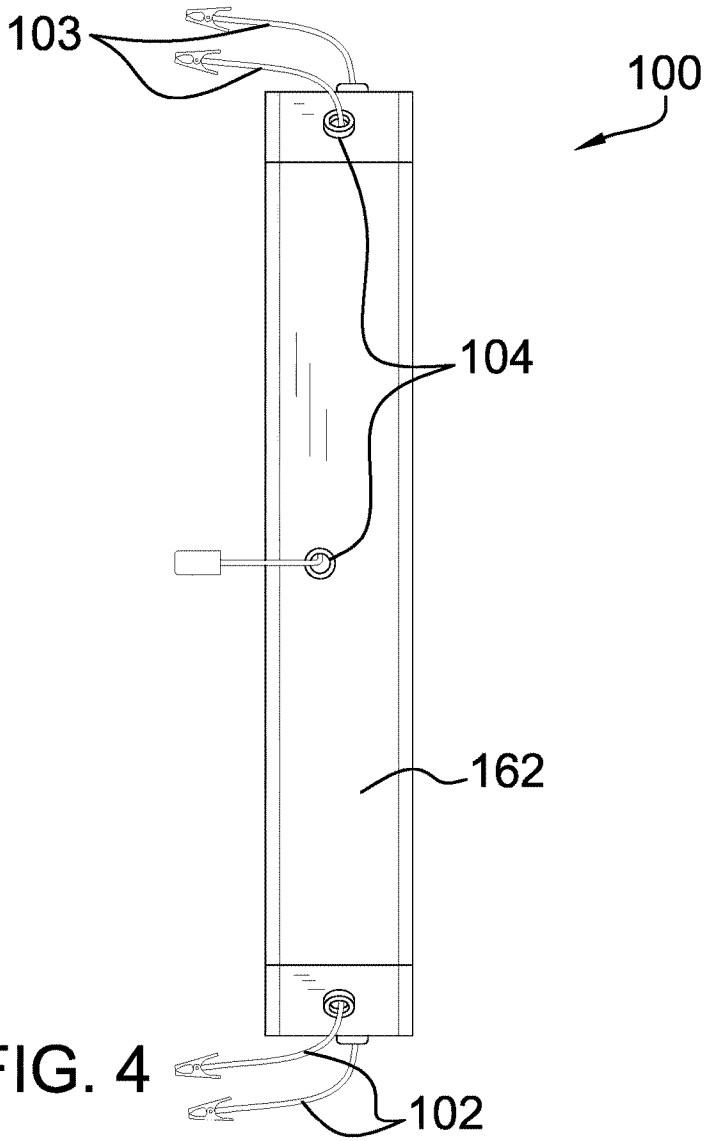
FIG. 4 is a reverse side view of an embodiment of the disclosure.
Figure 3:
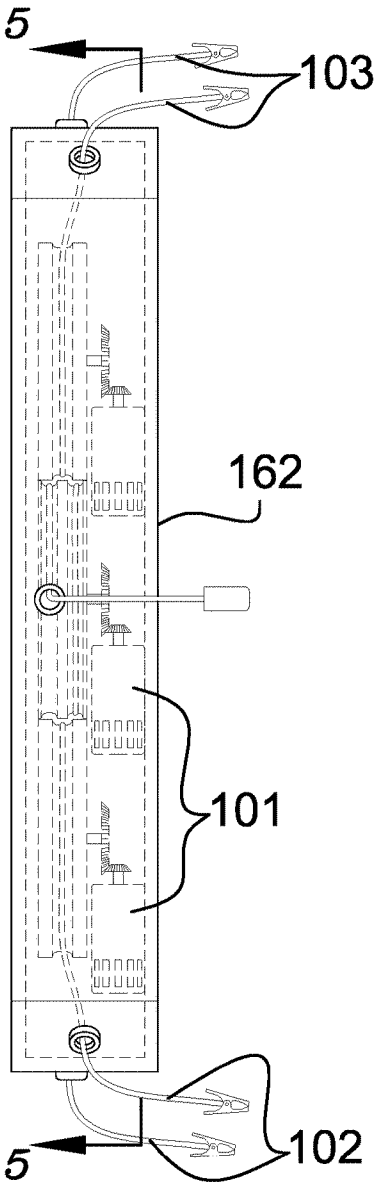
FIG. 3 is a side view of an embodiment of the disclosure.
Figure 5:
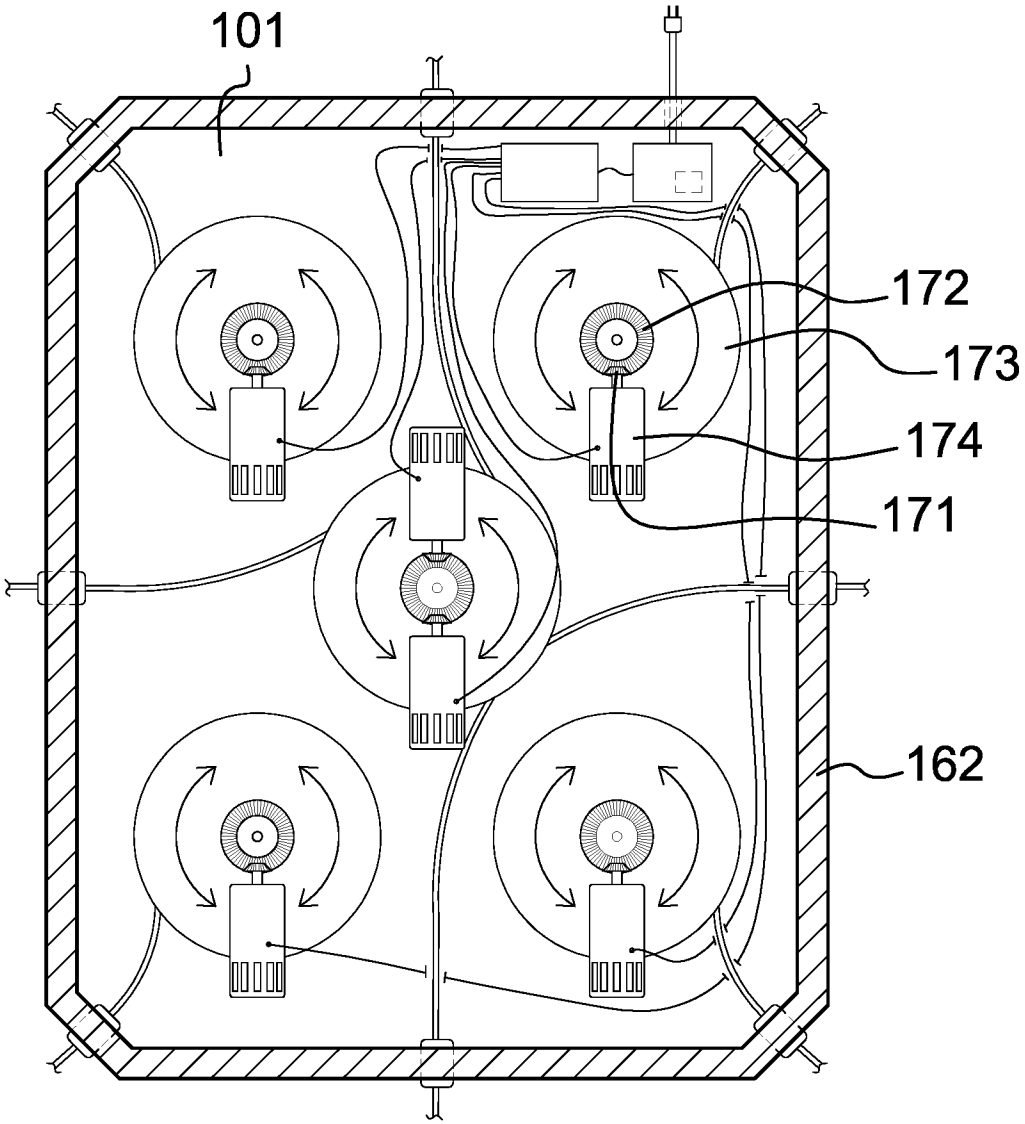
FIG. 5 is a cross-sectional view of an embodiment of the disclosure across 5-5 as shown in FIG. 3.
Figure 6:
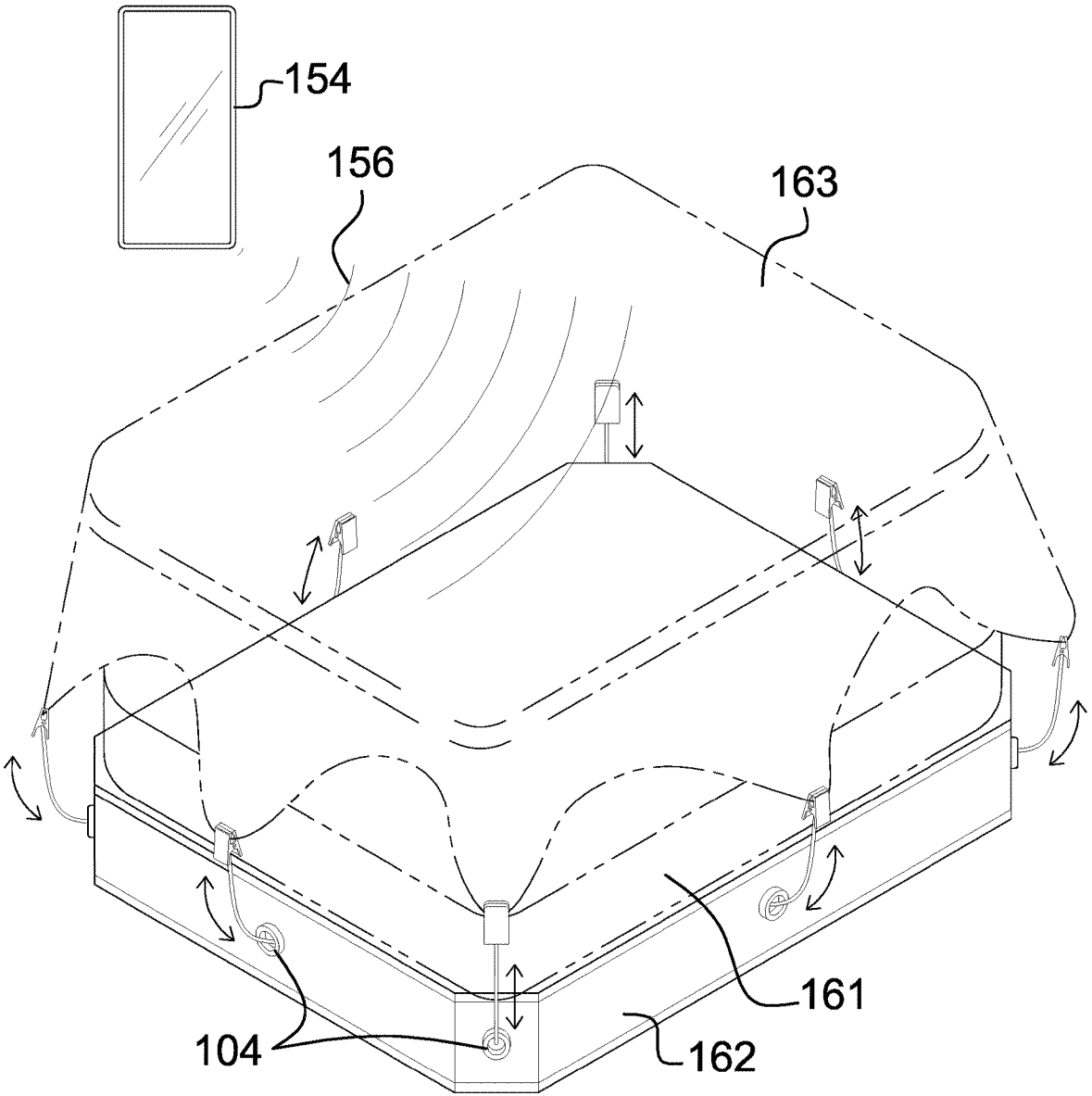
FIG. 6 is an in-use view of an embodiment of the disclosure.
Figure 7:
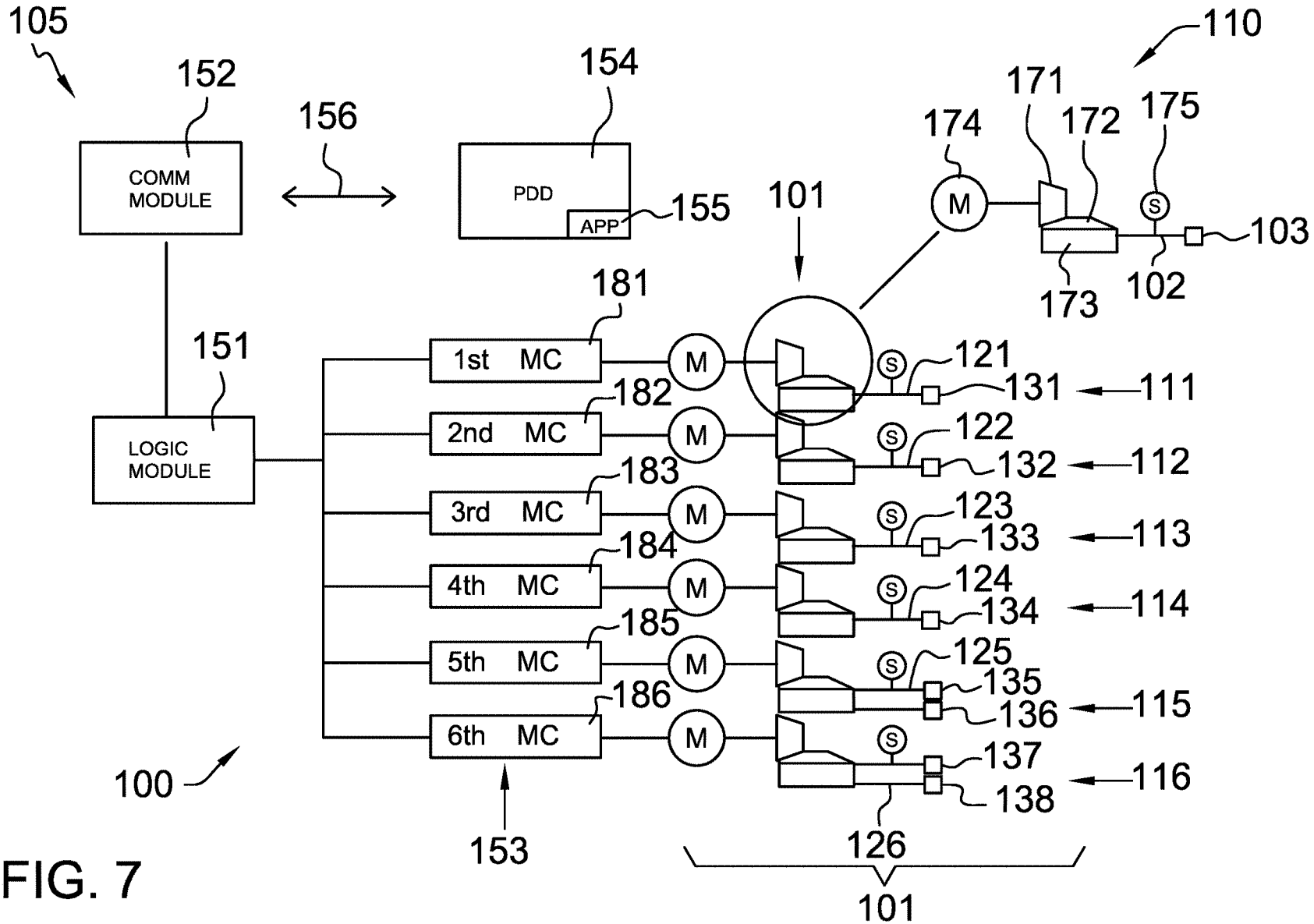
FIG. 7 is a schematic view of an embodiment of the disclosure.

Detailed reference will now be made to one or more potential embodiments of the disclosure, which are illustrated in FIGS. 1 through 7.

The bed sheet tensioning system 100 (hereinafter invention) is configured for use with a bed 106. The bed 106 comprises a mattress 161, a box spring 162, and a sheet 163. The invention 100 mounts in the box spring 162. The invention 100 attaches to the perimeter of the sheet 163 at two or more locations. The invention 100 applies a tension to the sheet 163 as the sheet 163 is placed over the mattress 161. The invention 100 comprises a plurality of tensioning devices 101, a plurality of cords 102, a plurality of clips 103, a plurality of grommets 104, and a control circuit 105. The plurality of cords 102 and the plurality of clips 103 secure the sheet 163 to the tensioning device. The plurality of grommets 104 protect and guide the plurality of cords 102 through the box spring 162. The control circuit 105 independently controls the operation of each of the plurality of tensioning devices 101.

The plurality of tensioning devices 101 comprises a collection of individual tensioning devices 110. Each individual tensioning device 110 selected from the plurality of tensioning devices 101 is identical.

The control circuit 105 independently controls each of the individual tensioning devices 110. Each individual tensioning device 110 selected from the plurality of tensioning devices 101 applies a tension to a cord selected from the plurality of cords 102. The tension applied to each of the plurality of cords 102 by the plurality of tensioning devices 101 pulls the sheet 163 tightly around the mattress 161 such that the sheet 163 lies straight and taught on the mattress 161. Each individual tensioning device 110 selected from the plurality of tensioning devices 101 is electrically powered. The individual tensioning device 110 selected from the plurality of tensioning devices 101 is independently controlled by the control circuit 105. Each of the plurality of cords 102 is a cord that attaches to an individual tensioning device 110 selected from the plurality of tensioning devices 101.

The individual tensioning device 110 controls the tension applied to a cord selected from the plurality of cords 102. The individual tensioning device 110 controls the tension applied to the selected cord by controlling the span of the length of the cord as measured from the individual tensioning device 110 to the sheet 163 that the selected cord is attached to. The individual tensioning device 110 measures the tension applied to the selected cord and transmits data regarding the tension on the selected cord to the control circuit 105.

The individual tensioning device 110 comprises a first bevel gear 171, a second bevel gear 172, a spool 173, a tension motor 174, and a tension sensor 175.

The first bevel gear 171 is a bevel gear. The first bevel gear 171 attaches to the tension motor 174 such that the rotation of the tension motor 174 rotates the first bevel gear 171 on an axis of rotation that aligns the axis of rotation of the tension motor 174. The second bevel gear 172 is a bevel gear. The first bevel gear 171 meshes with the second bevel gear 172 such that the rotation of the first bevel gear 171 rotates the second bevel gear 172. The first bevel gear 171 meshes with the second bevel gear 172 such that the axis of rotation of the second bevel gear 172 forms a cant with the axis of rotation of the first bevel gear 171. The bevel gear is defined elsewhere in this disclosure.

The spool 173 is a mechanical structure that stores the cord selected from the plurality of cords 102 that is associated with the individual tensioning device 110. The individual tensioning device 110 retracts its associated cord onto the spool 173 when the logic module 151 of the control circuit 105 determines that additional tension needs to be applied to the associated cord. The individual tensioning device 110 deploys its associated cord from the spool 173 when the logic module 151 of the control circuit 105 determines that tension needs to be removed from the associated cord.

The tension motor 174 is an electric motor. The logic module 151 of the control circuit 105 controls the operation of the tension motor 174. The tension motor 174 attaches to the first bevel gear 171 such that the rotation of the tension motor 174 rotates the first bevel gear 171.

The tension sensor 175 is an electric sensor. The tension sensor 175 electrically connects to the logic module 151 of the control circuit 105. The tension sensor 175 transmits the measured tension on the cord associated with the individual tensioning device 110 to the logic module 151 of the control circuit 105.

Each of the plurality of cords 102 transfers a tensile force generated by the selected individual tensioning device 110 to the sheet 163. Each of the plurality of clips 103 is associated with a cord selected from the plurality of cords 102. The plurality of tensioning devices 101 further comprises a first tensioning device 111, a second tensioning device 112, a third tensioning device 113, a fourth tensioning device 114, a fifth tensioning device 115, and a sixth tensioning device 116. The plurality of cords 102 comprises a first cord 121, a second cord 122, a third cord 123, a fourth cord 124, a fifth cord 125, and a sixth cord 126.

The first cord 121 is the cord selected from the plurality of cords 102 that is associated with the first tensioning device 111. The second cord 122 is the cord selected from the plurality of cords 102 that is associated with the second tensioning device 112. The third cord 123 is the cord selected from the plurality of cords 102 that is associated with the third tensioning device 113. The fourth cord 124 is the cord selected from the plurality of cords 102 that is associated with the fourth tensioning device 114. The fifth cord 125 is the cord selected from the plurality of cords 102 that is associated with the fifth tensioning device 115. The sixth cord 126 is the cord selected from the plurality of cords 102 that is associated with the sixth tensioning device 116.

Each of the plurality of clips 103 attaches its selected cord to the sheet 163 such that the tension applied to the selected cord is transferred to the sheet 163. The plurality of clips 103 comprises a first clip 131, a second clip 132, a third clip 133, a fourth clip 134, a fifth clip 135, a sixth clip 136, a seventh clip 137, and an eighth clip 138.

The first clip 131 is the clip selected from the plurality of clips 103 that secures the free end of the first cord 121 to the perimeter of the sheet 163. The second clip 132 is the clip selected from the plurality of clips 103 that secures the free end of the second cord 122 to the perimeter of the sheet 163. The third clip 133 is the clip selected from the plurality of clips 103 that secures the free end of the third cord 123 to the perimeter of the sheet 163. The fourth clip 134 is the clip selected from the plurality of clips 103 that secures the free end of the fourth cord 124 to the perimeter of the sheet 163.

The fifth clip 135 is the clip selected from the plurality of clips 103 that secures a first end of the fifth cord 125 to the perimeter of the sheet 163. The sixth clip 136 is the clip selected from the plurality of clips 103 that secures a second end of the fifth cord 125 to the perimeter of the sheet 163.

The seventh clip 137 is the clip selected from the plurality of clips 103 that secures a first end of the sixth cord 126 to the perimeter of the sheet 163. The eighth clip 138 is the clip selected from the plurality of clips 103 that secures a second end of the sixth cord 126 to the perimeter of the sheet 163.

The plurality of grommets 104 is a disk-shaped structure. Each of the plurality of grommets 104 is formed as a ring. Each of the plurality of grommets 104 mounts in the box spring 162. Each of the plurality of grommets 104 forms a negative space through the exterior surface of the box spring 162 through which a cord selected from the plurality of cords 102 inserts. Each of the plurality of grommets 104 forms a smooth channel that protects the selected cord from damage as the selected cord is drawn through its selected grommet. The plurality of grommets 104 comprises a first grommet 141, a second grommet 142, a third grommet 143, a fourth grommet 144, a fifth grommet 145, a sixth grommet 146, a seventh grommet 147, and an eighth grommet 148.

The first grommet 141 is the grommet selected from the plurality of grommets 104 that protects the first cord 121 as it passes through the box spring 162. The second grommet 142 is the grommet selected from the plurality of grommets 104 that protects the second cord 122 as it passes through the box spring 162. The third grommet 143 is the grommet selected from the plurality of grommets 104 that protects the third cord 123 as it passes through the box spring 162. The fourth grommet 144 is the grommet selected from the plurality of grommets 104 that protects the fourth cord 124 as it passes through the box spring 162.

The fifth grommet 145 is the grommet selected from the plurality of grommets 104 that protects the fifth cord 125 as it passes through the box spring 162. The sixth grommet 146 is the grommet selected from the plurality of grommets 104 that protects the fifth cord 125 as it passes through the box spring 162.

The seventh grommet 147 is the grommet selected from the plurality of grommets 104 that protects the sixth cord 126 as it passes through the box spring 162. The eighth grommet 148 is the grommet selected from the plurality of grommets 104 that protects the sixth cord 126 as it passes through the box spring 162.

The control circuit 105 is an electric circuit. The control circuit 105 independently controls the operation of each of the plurality of tensioning devices 101.

The control circuit 105 monitors the tension sensor 175 of each individual tensioning device 110 selected from the plurality of tensioning devices 101 to determine the tension applied to the cord associated with the selected individual tensioning device 110. The control circuit 105 uses the tension measured by the tension sensor 175 to determine when the tension motor 174 of each individual tensioning device 110 needs to be operated. The control circuit 105 uses the tension measured by the tension sensor 175 to determine the speed of rotation of the tension motor 174. The control circuit 105 uses the tension measured by the tension sensor 175 to determine the direction of rotation of the tension motor 174.

The control circuit 105 establishes a wireless communication link 156 with a personal data device 154. The control circuit 105 receives operating instructions and parameters from the personal data device 154 over the wireless communication link 156.

The control circuit 105 comprises a logic module 151, a communication module 152, and a plurality of motor controllers 153. The logic module 151, the communication module 152, and the plurality of motor controllers 153 are electrically interconnected. The communication module 152 further comprises a personal data device 154 and a wireless communication link 156. The communication module 152 forms the wireless communication link 156 between the control circuit 105 and a personal data device 154.

The logic module 151 is a readily and commercially available programmable electronic device that is used to manage, regulate, and operate the control circuit 105. The communication module 152 is a wireless electronic communication device that allows the logic module 151 to wirelessly communicate with a personal data device 154. Specifically, the communication module 152 establishes a wireless communication link 156 between the control circuit 105 and the personal data device 154. In the first potential embodiment of the disclosure, the communication module 152 supports a communication protocol selected from the group consisting of a WiFi™ protocol or a Bluetooth™ protocol.

The personal data device 154 is a programmable electrical device that provides data management and communication services through one or more functions referred to as an application 155. The application 155 is a set of logical operating instructions that are performed by the personal data device 154. The addition of an application 155 will provide increased functionality for the personal data device 154. This disclosure assumes that an application 155 exists for the purpose of interacting with the invention 100. Methods to design and implement an application 155 on a personal data device 154 are well known and documented in the electrical arts.

The personal data device 154 forms an interface between the control circuit 105 and a client using the invention 100. The personal data device 154 transmits operating instructions over the wireless communication link 156 to the control circuit 105. The communication module 152 receives the transmitted operating instructions and relays the received operating instructions to the logic module 151.

Each of the plurality of motor controllers 153 is an electric motor control device. Each of the plurality of motor controllers 153 controls the speed of rotation of a tension motor 174 of an individual tensioning device 110 selected from the plurality of tensioning devices 101. Each of the plurality of motor controllers 153 controls the direction of rotation of a tension motor 174 of an individual tensioning device 110 selected from the plurality of tensioning devices 101.

The logic module 151 independently controls each motor controller selected from the plurality of motor controllers 153. By independently controlled is meant that the selection of the speed of rotation generated by any motor controller initially selected from the plurality of motor controllers 153 does not influence the speed of rotation generated by any motor controller subsequently selected from the plurality of motor controllers 153. By independently controlled is further meant that the selection of the direction of rotation generated by any motor controller initially selected from the plurality of motor controllers 153 does not influence the direction of rotation generated by any motor controller subsequently selected from the plurality of motor controllers 153.

The logic module 151 monitors the tension sensor 175 of each individual tensioning device 110 selected from the plurality of tensioning devices 101 to determine the tension applied to the cord associated with the selected individual tensioning device 110. The logic module 151 uses the tension measured by the tension sensor 175 to determine when the tension motor 174 of each individual tensioning device 110 needs to be operated. The logic module 151 uses the tension measured by the tension sensor 175 to determine the speed of rotation of the tension motor 174. The logic module 151 uses the tension measured by the tension sensor 175 to determine the direction of rotation of the tension motor 174.

The logic module 151 establishes the wireless communication link 156 with a personal data device 154. The logic module 151 receives operating instructions and parameters from the personal data device 154 over the wireless communication link 156.

The plurality of motor controllers 153 comprises a first motor controller 181, a second motor controller 182, a third motor controller 183, a fourth motor controller 184, a fifth motor controller 185, and a sixth motor controller 186.

The first motor controller 181 controls the speed of rotation and the direction of rotation of the tension motor 174 of the first tensioning device 111. The logic module 151 independently controls the operation of the first motor controller 181.

The second motor controller 182 controls the speed of rotation and the direction of rotation of the tension motor 174 of the second tensioning device 112. The logic module 151 independently controls the operation of the second motor controller 182.

The third motor controller 183 controls the speed of rotation and the direction of rotation of the tension motor 174 of the third tensioning device 113. The logic module 151 independently controls the operation of the third motor controller 183.

The fourth motor controller 184 controls the speed of rotation and the direction of rotation of the tension motor 174 of the fourth tensioning device 114. The logic module 151 independently controls the operation of the fourth motor controller 184.

The fifth motor controller 185 controls the speed of rotation and the direction of rotation of the tension motor 174 of the fifth tensioning device 115. The logic module 151 independently controls the operation of the fifth motor controller 185.

The sixth motor controller 186 controls the speed of rotation and the direction of rotation of the tension motor 174 of the sixth tensioning device 116. The logic module 151 independently controls the operation of the sixth motor controller 186.

The fixed end of the first cord 121 attaches to the spool 173 of the first tensioning 111. The fixed end of the second cord 122 attaches to the spool 173 of the second tensioning 112. The fixed end of the third cord 123 attaches to the spool 173 of the third tensioning 113. The fixed end of the fourth cord 124 attaches to the spool 173 of the fourth tensioning 114. The bight of the fifth cord 125 attaches to the spool 173 of the fifth tensioning 115. The bight of the sixth cord 126 attaches to the spool 173 of the sixth tensioning 116.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Application or App: As used in this disclosure, an application or app is a self-contained piece of software that is especially designed or downloaded for use with a personal data device.

Bed: As used in this disclosure, a bed refers to a structure, typically a furniture item, used for sleeping or resting. When the structure is a furniture item, the bed comprises a frame and a mattress. The frame is a pedestal that elevates the mattress. A bed often further comprises one or more box frames. The one or more box frames are mechanical structures that form secondary pedestals that elevate the mattress above the frame.

Bedding: As used in this disclosure, bedding refers to textile items use to cover or enclose the mattress or frame of a bed. Common bedding items include sheets, blankets, and pillow cases.

Bevel Gear: As used in this disclosure, a bevel gear is a gear with teeth that are formed on a conical surface that is used to transmit motion between non-parallel or intersecting shafts.

Bight: As used in this disclosure, a bight refers to any central location on a cord, rope, or line.

Bluetooth™: As used in this disclosure, Bluetooth™ is a standardized communication protocol that is used to wirelessly interconnect electronic devices.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Clip: As used in this disclosure, a clip is a fastener that attaches to an object by gripping or clasping the object. A clip is typically spring loaded.

Communication Link: As used in this disclosure, a communication link refers to the structured exchange of data between two objects.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is an elastomeric structure formed that is used to prevent injury or damage to a person or object.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Eyelet: As used in this disclosure, an eyelet is a ring shaped mechanical structure intended to have a cord passed through the aperture of the ring structure.

Fixed End: As used in this disclosure, a fixed end refers to the end of a cord or webbing that attaches to an object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Free End: As used in this disclosure, a free end refers to the end of a cord or webbing that is not secured to an object.

Gear: As used in this disclosure, a gear is a toothed wheel, cylinder, or other toothed mechanical element that is used to transmit motion, a change of speed, or a change of direction to second toothed wheel, cylinder, or other toothed mechanical element.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grommet: As used in this disclosure, a grommet is an eyelet placed in a hole in a textile, sheet, or panel that protects a rope hook or cable passed through it and to protect the textile, sheet, or panel from being torn. See bushing and flange.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Independent: As used in this disclosure, the term independent refers to the relationship between the operation and control of a first device and a second device. The first device and the second device are independent from each other if: a) the operation of the first device is neither impacted nor influenced by the operation of the second device; and, b) the operation of the second device is neither impacted nor influenced by the operation of the first device.

Inferior: As used in this disclosure, the term inferior refers to a directional reference that is parallel to and in the same direction as the force of gravity when an object is positioned or used normally.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Mattress: As used in this disclosure, a mattress is a disk-shaped structure that forms a cushion used by a patient when lying flat. The superior congruent end of the disk structure of the mattress forms a horizontally oriented surface.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed, and the direction of rotation of an electric motor. Motor controllers will generally receive one or more inputs which are used determine the desired rotational speed and direction of rotation of the electric motor.

Negative Space: As used in this disclosure, negative space is a method of defining an object through the use of open or empty space as the definition of the object itself, or, through the use of open or empty space to describe the boundaries of an object.

N-gon: As used in this disclosure, an N-gon is a regular polygon with N sides wherein N is a positive integer number greater than 2.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Orientation: As used in this disclosure, orientation refers to the positioning of a first object relative to: 1) a second object; or, 2) a fixed position, location, or direction.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

PDD: As used in this disclosure, PDD is an acronym for personal data device.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Personal Data Device: As used in this disclosure, a personal data device is a handheld logical device that is used for managing personal information and communication. Examples of personal data device include, but are not limited to, cellular phones, tablets, and smartphones. See logical device Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as a cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

Relaxed Shape: As used in this disclosure, a structure is considered to be in its relaxed state when no shear, strain, or torsional forces are being applied to the structure.

Ring: As used in this disclosure, a ring is term that is used to describe a disk-like structure through which a negative space is formed through the faces of the disk-like structure. Rings are often considered loops.

Sheet: As used in this disclosure, a sheet is a textile based sheeting used to cover the mattress of a bed. A fitted sheet is a sheet that is further formed with seams and an optional elastic webbing such that the sheet is secured to the mattress without folding.

Spool: As used in this disclosure, a spool is a cylindrical device upon which a flexible material, including but not limited to a sheeting, yarn, a cord, or a tape, can be wound. Depending on context, a spool may also contain the flexible material stored upon the spool.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Tension: As used in this disclosure, tension refers to a force applied to an object such that the force will stretch the span of length of the object along the direction of the force.

Truncated: As used in this disclosure, a geometric object is truncated when an apex, vertex, or end is cut off by a line or plane.

Truncated Cone: As used in this disclosure, a truncated cone is a frustum that remains when the apex of a cone is truncated by a plane that is parallel to the base of the cone.

Truncated Pyramid: As used in this disclosure, a truncated pyramid is a frustum that remains when the apex of a pyramid is truncated by a plane that is parallel to the base of the pyramid.

Vertex: As used in this disclosure, a vertex (plural vertices) is an angle that is formed by two lines that form a point. Vertices are commonly found in polygons.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

WiFi™: As used in this disclosure, WiFi™ refers to the physical implementation of a collection of wireless electronic communication standards commonly referred to as IEEE 802.11x.

Wireless: As used in this disclosure, wireless is an adjective that is used to describe a communication link between two devices that does not require the use of physical cabling.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A bed sheet tensioning system comprising a plurality of tensioning devices, a plurality of cords, a plurality of clips, a plurality of grommets, and a control circuit; wherein the plurality of cords and the plurality of clips are configured to secure a sheet of a bed to the plurality of tensioning devices; wherein the plurality of grommets protect and guide the plurality of cords through a box spring; wherein the control circuit independently controls the operation of each of the plurality of tensioning devices; wherein the bed sheet tensioning system is configured for use in applying a tension to a sheet of a bed.

2. The bed sheet tensioning system according to claim 1
wherein the bed sheet tensioning system mounts in the box spring;
wherein the plurality of tensioning devices comprises a collection of individual tensioning devices;
wherein each individual tensioning device selected from the plurality of tensioning devices is identical;
wherein each individual tensioning device selected from the plurality of tensioning devices applies a tension to a cord selected from the plurality of cords;
wherein each individual tensioning device selected from the plurality of tensioning devices is electrically powered;
wherein the individual tensioning device selected from the plurality of tensioning devices is independently controlled by the control circuit.

3. The bed sheet tensioning system according to claim 2
wherein each of the plurality of cords is a cord that attaches to an individual tensioning device selected from the plurality of tensioning devices;
wherein each of the plurality of clips is associated with a cord selected from the plurality of cords.

4. The bed sheet tensioning system according to claim 3 wherein the individual tensioning device controls the tension applied to a cord selected from the plurality of cords; wherein the individual tensioning device controls the tension applied to the selected cord by controlling a span of a length of the cord as measured from the individual tensioning device to the sheet that the selected cord is attached to; wherein the individual tensioning device measures the tension applied to the selected cord and transmits data regarding the tension on the selected cord to the control circuit.

5. The bed sheet tensioning system according to claim 4
wherein the plurality of grommets is a disk-shaped structure;
wherein each of the plurality of grommets is formed as a ring;
wherein each of the plurality of grommets mounts in the box spring;
wherein each of the plurality of grommets forms a negative space through the exterior surface of the box spring through which a cord selected from the plurality of cords inserts.

6. The bed sheet tensioning system according to claim 5
wherein the individual tensioning device comprises a first bevel gear, a second bevel gear, a spool, a tension motor, and a tension sensor;
wherein the tension motor attaches to the first bevel gear;
wherein the second bevel gear attaches to the first bevel gear;
wherein the spool attaches to the second bevel gear;
wherein the tension sensor measures the tension on a cord selected from the plurality of cords.

7. The bed sheet tensioning system according to claim 6 wherein the first bevel gear is a bevel gear; wherein the first bevel gear attaches to the tension motor such that a rotation of the tension motor rotates the first bevel gear on an axis of rotation that aligns the axis of rotation of the tension motor; wherein the second bevel gear is a bevel gear; wherein the first bevel gear meshes with the second bevel gear such that a rotation of the first bevel gear rotates the second bevel gear; wherein the first bevel gear meshes with the second bevel gear such that the axis of rotation of the second bevel gear forms a cant with the axis of rotation of the first bevel gear.

8. The bed sheet tensioning system according to claim 7 wherein the spool is a mechanical structure that stores the cord selected from the plurality of cords that is associated with the individual tensioning device; wherein the individual tensioning device retracts a corresponding associated cord onto the spool when the logic module of the control circuit determines that additional tension needs to be applied to the associated cord; wherein the individual tensioning device deploys its the corresponding associated cord from the spool when the logic module of the control circuit determines that tension needs to be removed from the associated cord.

9. The bed sheet tensioning system according to claim 8
wherein the tension motor is an electric motor;
wherein the control circuit controls the operation of the tension motor;
wherein the tension motor attaches to the first bevel gear such that the rotation of the tension motor rotates the first bevel gear.

10. The bed sheet tensioning system according to claim 9
wherein the tension sensor is an electric sensor;
wherein the tension sensor electrically connects to the control circuit;
wherein the tension sensor transmits the measured tension on the cord associated with the individual tensioning device to the control circuit.

11. The bed sheet tensioning system according to claim 10 wherein the control circuit is an electric circuit; wherein the control circuit independently controls the operation of each of the plurality of tensioning devices; wherein the control circuit monitors the tension sensor of each individual tensioning device selected from the plurality of tensioning devices to determine the tension applied to the cord associated with the selected individual tensioning device; wherein the control circuit uses the tension measured by the tension sensor to determine when the tension motor of each individual tensioning device needs to be operated; wherein the control circuit uses the tension measured by the tension sensor to determine a speed of rotation of the tension motor; wherein the control circuit uses the tension measured by the tension sensor to determine the direction of rotation of the tension motor.

12. The bed sheet tensioning system according to claim 11 wherein the control circuit establishes a wireless communication link with a personal data device;

wherein the control circuit receives operating instructions and parameters from the personal data device over the wireless communication link.

13. The bed sheet tensioning system according to claim 12 wherein the control circuit comprises a logic module, a communication module, and a plurality of motor controllers;

wherein the logic module, the communication module, and the plurality of motor controllers are electrically interconnected;

wherein the communication module further comprises a personal data device and a wireless communication link;

wherein the communication module forms the wireless communication link between the control circuit and the personal data device;

wherein the logic module is a programmable electronic device;

wherein the communication module is a wireless electronic communication device;

wherein the communication module establishes the wireless communication link between the control circuit and the personal data device;

wherein the personal data device forms an interface for the control circuit;

wherein the personal data device transmits operating instructions over the wireless communication link to the control circuit;

wherein the communication module receives the transmitted operating instructions and relays the received operating instructions to the logic module.

14. The bed sheet tensioning system according to claim 13 wherein each of the plurality of motor controllers is an electric motor control device;

wherein each of the plurality of motor controllers controls the speed of rotation of a tension motor of an individual tensioning device selected from the plurality of tensioning devices;

wherein each of the plurality of motor controllers controls the direction of rotation of a tension motor of an individual tensioning device selected from the plurality of tensioning devices;

wherein the logic module independently controls each motor controller selected from the plurality of motor controllers;

wherein by independently controlled is meant that the selection of the speed of rotation generated by any motor controller initially selected from the plurality of motor controllers does not influence the speed of rotation generated by any motor controller subsequently selected from the plurality of motor controllers;

wherein by independently controlled is further meant that the selection of the direction of rotation generated by any motor controller initially selected from the plurality of motor controllers does not influence the direction of rotation generated by any motor controller subsequently selected from the plurality of motor controllers;

wherein the logic module monitors the tension sensor of each individual tensioning device selected from the plurality of tensioning devices to determine the tension applied to the cord associated with the selected individual tensioning device;

wherein the logic module uses the tension measured by the tension sensor to determine when the tension motor of each individual tensioning device needs to be operated;

wherein the logic module uses the tension measured by the tension sensor to determine the speed of rotation of the tension motor;

wherein the logic module uses the tension measured by the tension sensor to determine the direction of rotation of the tension motor.

15. The bed sheet tensioning system according to claim 14 wherein the plurality of motor controllers comprises a first motor controller, a second motor controller, a third motor controller, a fourth motor controller, a fifth motor controller, and a sixth motor controller;

wherein the first motor controller controls the speed of rotation and the direction of rotation of the tension motor of the first tensioning device;

wherein the logic module independently controls the operation of the first motor controller;

wherein the second motor controller controls the speed of rotation and the direction of rotation of the tension motor of the second tensioning device;

wherein the logic module independently controls the operation of the second motor controller;

wherein the third motor controller controls the speed of rotation and the direction of rotation of the tension motor of the third tensioning device;

wherein the logic module independently controls the operation of the third motor controller;

wherein the fourth motor controller controls the speed of rotation and the direction of rotation of the tension motor of the fourth tensioning device;

wherein the logic module independently controls the operation of the fourth motor controller;

wherein the fifth motor controller controls the speed of rotation and the direction of rotation of the tension motor of the fifth tensioning device;

wherein the logic module independently controls the operation of the fifth motor controller;

wherein the sixth motor controller controls the speed of rotation and the direction of rotation of the tension motor of the sixth tensioning device;

wherein the logic module independently controls the operation of the sixth motor controller.

16. The bed sheet tensioning system according to claim 15 wherein the plurality of tensioning devices further comprises a first tensioning device, a second tensioning device, a third tensioning device, a fourth tensioning device, a fifth tensioning device, and a sixth tensioning device;

wherein the plurality of cords comprises a first cord, a second cord, a third cord, a fourth cord, a fifth cord, and a sixth cord;

wherein the first cord is the cord selected from the plurality of cords that is associated with the first tensioning device;

wherein the second cord is the cord selected from the plurality of cords that is associated with the second tensioning device;

wherein the third cord is the cord selected from the plurality of cords that is associated with the third tensioning device;

wherein the fourth cord is the cord selected from the plurality of cords that is associated with the fourth tensioning device;

wherein the fifth cord is the cord selected from the plurality of cords that is associated with the fifth tensioning device;

wherein the sixth cord is the cord selected from the plurality of cords that is associated with the sixth tensioning device.

17. The bed sheet tensioning system according to claim 16 wherein each of the plurality of clips attaches a corresponding selected cord to the sheet such that the tension applied to the selected cord is transferred to the sheet; wherein the plurality of clips comprises a first clip, a second clip, a third clip, a fourth clip, a fifth clip, a sixth clip, a seventh clip, and an eighth clip; wherein the first clip is the clip selected from the plurality of clips that secures the free end of the first cord to a perimeter of the sheet; wherein the second clip is the clip selected from the plurality of clips that secures the free end of the second cord to the perimeter of the sheet; wherein the third clip is the clip selected from the plurality of clips that secures the free end of the third cord to the perimeter of the sheet; wherein the fourth clip is the clip selected from the plurality of clips that secures the free end of the fourth cord to the perimeter of the sheet; wherein the fifth clip is the clip selected from the plurality of clips that secures a first end of the fifth cord to the perimeter of the sheet; wherein the sixth clip is the clip selected from the plurality of clips that secures a second end of the fifth cord to the perimeter of the sheet; wherein the seventh clip is the clip selected from the plurality of clips that secures a first end of the sixth cord to the perimeter of the sheet; wherein the eighth clip is the clip selected from the plurality of clips that secures a second end of the sixth cord to the perimeter of the sheet.

18. The bed sheet tensioning system according to claim 17 wherein each of the plurality of grommets forms a smooth channel that protects the selected cord from damage as the selected cord is drawn through a corresponding selected grommet; wherein the plurality of grommets comprises a first grommet, a second grommet, a third grommet, a fourth grommet, a fifth grommet, a sixth grommet, a seventh grommet, and an eighth grommet; wherein the first grommet is the grommet selected from the plurality of grommets that protects the first cord as it passes through the box spring; wherein the second grommet is the grommet selected from the plurality of grommets that protects the second cord as it passes through the box spring; wherein the third grommet is the grommet selected from the plurality of grommets that protects the third cord as it passes through the box spring; wherein the fourth grommet is the grommet selected from the plurality of grommets that protects the fourth cord as it passes through the box spring; wherein the fifth grommet is the grommet selected from the plurality of grommets that protects the fifth cord as it passes through the box spring; wherein the sixth grommet is the grommet selected from the plurality of grommets that protects the fifth cord as it passes through the box spring; wherein the seventh grommet is the grommet selected from the plurality of grommets that protects the sixth cord as it passes through the box spring; wherein the eighth grommet is the grommet selected from the plurality of grommets that protects the sixth cord as it passes through the box spring.

19. The bed sheet tensioning system according to claim 18 wherein the fixed end of the first cord attaches to the spool of the first tensioning device; wherein the fixed end of the second cord attaches to the spool of the second tensioning device; wherein the fixed end of the third cord attaches to the spool of the third tensioning device; wherein the fixed end of the fourth cord attaches to the spool of the fourth tensioning device; wherein a bight of the fifth cord attaches to the spool of the fifth tensioning device; wherein a bight of the sixth cord attaches to the spool of the sixth tensioning device.

* * * * *